US010828577B2

(12) United States Patent
Golliher

(10) Patent No.: US 10,828,577 B2
(45) Date of Patent: Nov. 10, 2020

(54) TOY ROCKET LAUNCH PLATFORM SAFETY SYSTEM

(71) Applicant: Idea Vault Holdings Inc., Ashland, OR (US)

(72) Inventor: Clayton R. Golliher, Tujunga, CA (US)

(73) Assignee: Idea Vault Holdings Inc., Ashland, OR (US)

( * ) Notice: Subject to any disclaimer, the term of this patent is extended or adjusted under 35 U.S.C. 154(b) by 0 days.

(21) Appl. No.: 16/588,601

(22) Filed: Sep. 30, 2019

(65) Prior Publication Data

US 2020/0101395 A1 Apr. 2, 2020

Related U.S. Application Data

(60) Provisional application No. 62/739,315, filed on Sep. 30, 2018.

(51) Int. Cl.

| | |
|---|---|
| ***A63H 27/14*** | (2006.01) |
| ***A63H 30/02*** | (2006.01) |
| ***A63H 27/00*** | (2006.01) |

(52) U.S. Cl.

CPC ..... *A63H 27/14* (2013.01); *A63H 27/005* (2013.01); *A63H 30/02* (2013.01)

(58) Field of Classification Search

CPC ..... A63H 27/005; A63H 27/14

See application file for complete search history.

(56) References Cited

U.S. PATENT DOCUMENTS

| | | | | |
|---|---|---|---|---|
| 2,443,299 | A | 6/1948 | Brown | |
| 2,841,084 | A | 7/1958 | Carlisle | |
| 2,993,297 | A | 7/1961 | Bednar et al. | |
| 3,029,704 | A | 4/1962 | Truax | |
| 3,465,472 | A | 9/1969 | Novotny | |
| 3,831,315 | A * | 8/1974 | Gilbert | A63H 27/14 446/187 |
| 3,962,818 | A | 6/1976 | Pippin, Jr. | |
| 4,159,705 | A | 7/1979 | Jacoby | |
| 5,653,216 | A | 8/1997 | Johnson | |
| 5,839,940 | A * | 11/1998 | Ensmenger | A63H 27/005 446/212 |
| 6,315,629 | B1 | 11/2001 | Jones | |
| 6,321,737 | B1 | 11/2001 | Johnson et al. | |
| 6,361,393 | B1 * | 3/2002 | Seymour | A63H 27/005 446/129 |
| 6,460,531 | B1 | 10/2002 | Gourley et al. | |

(Continued)

*Primary Examiner* — John A Ricci

(57) ABSTRACT

Systems and methods for a toy rocket launch platform safety system are provided. Various embodiments include a system of switches attached to a moveable launch platform coupled to a static support structure via a pivot mechanism. The system of switches open when the moveable launch platform is not level to the ground or aligned along the central axis of the static support structure. When the system of switches is open, a toy rocket launch cannot occur. Some embodiments include a launch guidance system attached to the launch platform. A toy rocket is coupled to the launch guidance structure in such a way that the toy rocket assumes a trajectory dictated by the launch guidance structure. The launch guidance structure may be collapsible and when fully extended, achieves a height greater than that of the average adult.

20 Claims, 7 Drawing Sheets

(56) References Cited

U.S. PATENT DOCUMENTS

| | | | | |
|---|---|---|---|---|
| 6,945,495 | B1 | 9/2005 | Lund et al. | |
| 9,086,251 | B2 * | 7/2015 | Cummings | A63H 27/14 |
| 9,393,499 | B1 * | 7/2016 | Flanagan | A63H 3/003 |
| 2005/0009440 | A1 | 1/2005 | Foster et al. | |
| 2005/0085153 | A1 | 4/2005 | Rappaport | |
| 2009/0104839 | A1 | 4/2009 | Chang | |
| 2018/0133608 | A1 * | 5/2018 | Young | A63H 27/005 |

* cited by examiner

Molded

Threaded

TOY ROCKET LAUNCH PLATFORM SAFETY SYSTEM

CROSS-REFERENCE TO RELATED APPLICATIONS

This application claims priority to U.S. Provisional Application Ser. No. 62/739,315 filed Sep. 30, 2018, which is incorporated herein by reference in its entirety for all purposes.

TECHNICAL FIELD

Various embodiments of the present technology generally relate to electronic and mechanical control systems. More specifically, some embodiments of the present technology relate to a toy rocket launch platform safety system.

BACKGROUND

Toy rockets are popular and are generally directed towards children and amateur rocket enthusiasts. A typical toy rocket launch system includes a launch pad or launch platform whereby a user can set the toy rocket on and launch the toy rocket from. The typical launch platform may further include, a guidance pole positioned on the surface of the platform, and an ignition system to activate the rocket. Generally, the toy rocket is either inserted directly into the guidance pole or attached to it externally. When the rocket is ignited, the fuel contained within the rocket propels it along the path of the guidance pole into the air.

A central problem in toy rocket launch systems is the premature launch of a rocket when it is being moved or inadvertently bumped. Premature launches can result in people being stuck by the rocket when they are in the proximity of the launch pad. Traditional toy rocket launch systems often allow a rocket to be launched and escaping the guidance pole or tube. Unfortunately, the exit point of the guidance tube is shorter than the height of the person launching the toy rocket. Frequently, children will move the rocket to allow for adjustments or lifting, and in the process, accidentally trigger the launch mechanism resulting in the rocket injuring the person. Injury can also occur when a person simply leans over the launch tube while the rocket exists. Multiple lawsuits have been filed against various manufacturers because of children getting injured from being in the path of a rocket or because of accidental or premature launching.

As such, there are a number of challenges and inefficiencies created in traditional toy rocket launch systems. For example, traditional toy rocket launch systems are unable to prevent accidental or premature launches and are unable protect nearby bystanders from an inadvertent launch. Thus, it can be difficult to ensure the safety and wellbeing of those operating a toy rocket. It is with respect to these and other problems that embodiments of the present technology have been made.

SUMMARY

Systems and methods are described for a toy rocket launch safety system to prevent accidental or premature launches and the injuries that may result from such launches. In some embodiments, a system to facilitate safety and functionality for launching a toy rocket is presented. The system may include a moveable launch platform operatively coupled to a fixed base. The moveable launch platform presents an area on which a toy rocket may launch from or rest on before ignition. The moveable launch platform is positioned on top of the fixed base in such a way that it could move while the fixed base remains stationary. The fixed base rests directly on the ground or floor and comprises a support structure that can withstand the launch of a toy rocket. Connecting the fixed base to the moveable launch platform is a pivot mechanism positioned between the two platforms. The pivot mechanism may be a single post mounted as a ball and socket type assembly, a spring, or other pivoting post. This allows the moveable launch platform to tilt, pivot, or move latitudinally while the fixed base remains stationary. In other embodiments, the system further comprises an ignition system mounted to the surface of the moveable launch platform. The ignition system may be activated electronically by a handheld switch and placed on the surface of the moveable launch platform. Once activated, the ignition system will ignite the propellant contained within the toy rocket.

In further embodiments, the system may incorporate a circuitry system connecting a power supply to the ignition system. A plurality of switches that integrate into the circuitry system may be positioned near the periphery and on the underside of the moveable launch platform. The plurality of switches may comprise tilt switches, post switches, ball switches, or mercury switches. When the moveable launch platform is positioned on the central vertical axis of the fixed based and is level to the ground, the plurality of switches close causing the circuit to close. This action allows the power supply to provide power to the ignition system if the handheld switch is also closed. However, when the moveable launch platform is tilted or shifted horizontally, one or more of the plurality of switches will become disconnected thereby opening the circuit and cutting power to the handheld switch and by extension, the ignition system.

Some embodiments of the present technology include a launch guidance structure attached to the surface of the moveable launch platform. The launch guidance structure may take the form of a collapsible pole greater than six feet in length when extended and which screws onto the surface of the platform or is inserted into an appropriately sized mold on the platform. The launch guidance structure may comprise a series of smaller poles which may screw or snap into each other to form the entire assembly. In other embodiments, the launch guidance structure comprises a series of concentric poles which can telescope outwards from one another.

While multiple embodiments are disclosed, still other embodiments of the present technology will become apparent to those skilled in the art from the following detailed description, which shows and describes illustrative embodiments of the technology. As will be realized, the technology is capable of modifications in various aspects, all without departing from the scope of the present technology. Accordingly, the drawings and detailed description are to be regarded as illustrative in nature and not restrictive.

BRIEF DESCRIPTION OF THE DRAWINGS

Embodiments of the present technology will be described and explained through the use of the accompanying drawings.

Figure 1:
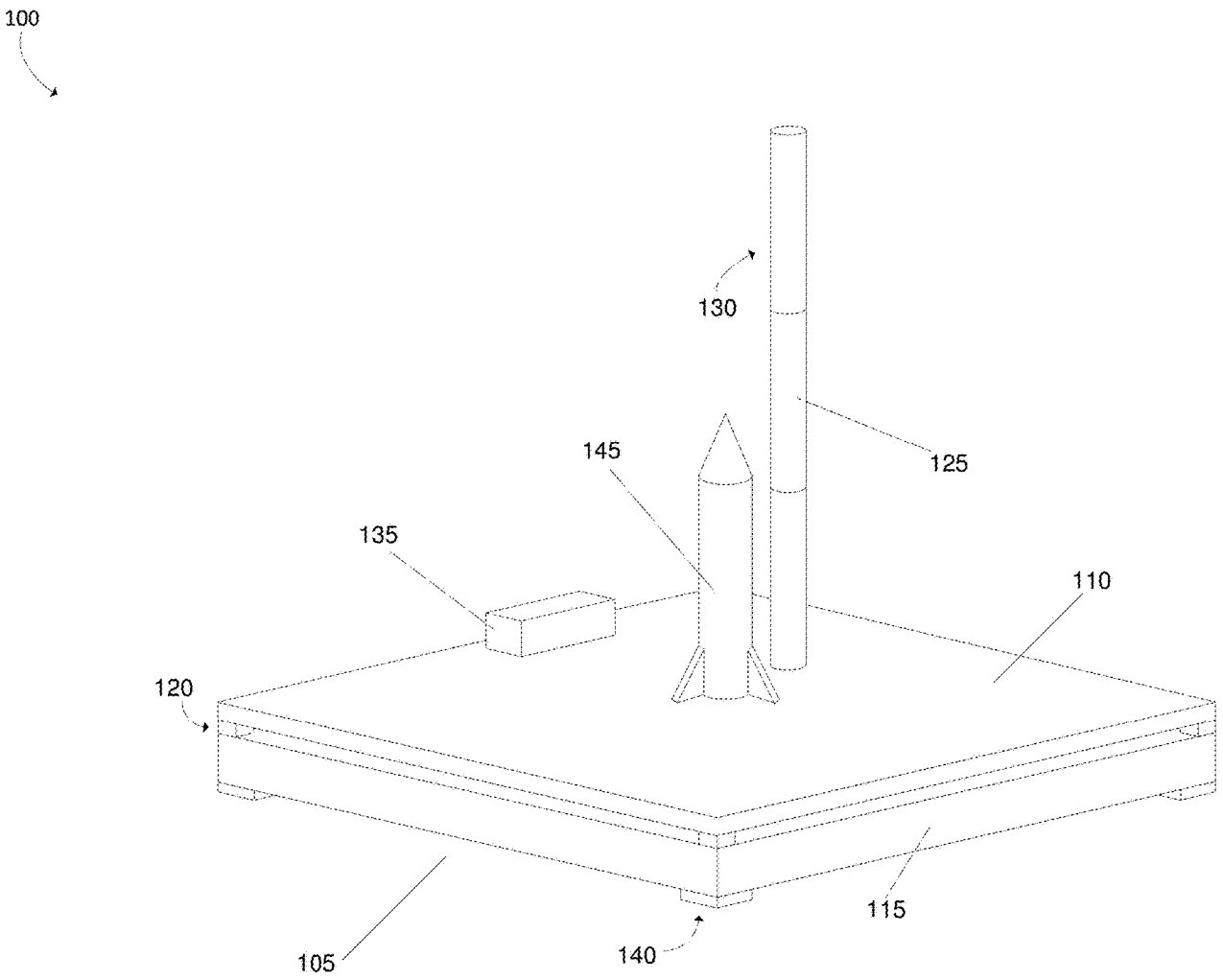
FIG. 1 illustrates an example of a toy rocket launch platform safety system in which some embodiments of the present technology may be utilized.

The drawings have not necessarily been drawn to scale. Similarly, some components and/or operations may be separated into different blocks or combined into a single block for the purposes of discussion of some of the embodiments of the present technology. Moreover, while the technology is amenable to various modifications and alternative forms, specific embodiments have been shown by way of example in the drawings and are described in detail below. The intention, however, is not to limit the technology to the particular embodiments described. On the contrary, the technology is intended to cover all modifications, equivalents, and alternatives falling within the scope of the technology as defined by the appended claims.

DETAILED DESCRIPTION

Various embodiments of the present technology relate generally to systems and methods of operation for a toy rocket launch platform safety system. More specifically, some embodiments of the present technology relate to a launch safety system which prevents a rocket launch from occurring when the launch pad is not positioned correctly. Further, some embodiments can prevent a rocket from exiting the launch platform at a height less than that of the average adult.

Toy rockets provide a variety of educational and recreational opportunities for children, young adults, and rocket enthusiasts. However, the safety systems embedded in traditional toy rocket systems are often inadequate and result in the injury of those operating the toy rocket. Injuries often occur when a rocket launches prematurely or launches at a non-vertical angle to the ground. Injuries can also occur when a person positions themselves in the path of the trajectory of the rocket even when the rocket is positioned to launch vertically. Various embodiments of the present technology provide systems and methods to overcome these deficiencies.

Some embodiments of the present technology relate to a toy rocket launch platform which provides a surface from which a toy rocket may be safely launched. In some embodiments, a toy rocket launch pad can include two subsections—a moveable launch surface pivotably coupled to a static support structure through a pivot mechanism. Positioned between the moveable launch surface and the static support structure, in some embodiments, may be a system of switches connected in series. When the moveable launch surface is positioned to be level to the ground on which the static support structure is set upon, the series of switches can be configured to be in a closed state that allows a path (e.g., an electrical path) which can be used to send an ignition signal allowing the toy rocket to take off. However, when the moveable launch surface is not level (e.g., substantially parallel) to the static support structure (and therefore the ground) or is positioned incorrectly in some other way, the series of switches change to an open state prohibiting transmission of an ignition signal thereby inhibiting a launch of the toy rocket. The moveable launch surface may also provide space for an ignition system to launch a rocket as well as space for a rocket to take off.

In some embodiments, a visual (e.g., light or LED panel) or audio indicator can be placed on the toy rocket launch pad, ignition switch, toy rocket, or other component of the system to provide a visual indication that the toy rocket launch platform will not allow the launch of the rocket (e.g., because the moveable launch surface is not level. As such, the user may have to find an alternative launch location if the ground is too unlevel. In some embodiments, the toy rocket launch platform may include leveling posts, casters, or other leveling mechanism. In some embodiments, the launch circuitry may include automated leveling features to adjust (e.g., without human intervention or with only a leveling command) the leveling mechanisms thereby allowing safe launch of the toy rocket. In some embodiments, the launch circuitry may include a processor and one or more vibration and tilt sensors. The vibration and tilt sensors can provide an electrical signal to the processor which can implement a feedback control system to automatically adjust the leveling mechanism and level the launch surface.

Some embodiments provide for a rocket launch platform with a moveable base, a moveable launch surface, and a static support structure. The moveable base can sit atop the static support structure and below the moveable launch surface. In some embodiments, the moveable base may provide a path for an ignition signal (e.g., via a series of switches). In some embodiments, the moveable base may shift laterally while remaining in contact with the static support structure. As such, the ignition path may remain closed (e.g., switches contained within the moveable base remain closed) when the moveable base is positioned along the centerline of the static support structure. However, when the moveable base shifts laterally and is no longer positioned along the centerline of the static support structure, the ignition path can open (e.g., switches contained within the moveable base open) to prevent launch of the toy rocket. When any one of the switches contained within the moveable base open, a toy rocket launch is inhibited.

Some embodiments of the present technology provide for a toy rocket launch platform with a launch guidance structure positioned on a launch surface. The launch guidance provides passive guidance for a toy rocket during takeoff. The launch guidance structure may be cylindrical and extend vertically from the launch surface of the toy rocket launch platform. A toy rocket may attach to the exterior of the launch guidance structure or may be inserted into the interior of the launch guidance structure so that when the toy rocket ignites, the toy rocket will follow a trajectory dictated by the launch guidance structure. The launch guidance structure extends vertically to a height greater than that of the average adult and may be collapsible. In some embodiments, the launch guidance structure can include series of concentric cylinders that telescope out from one another to a height greater than the average adult (e.g., greater than 5 feet 9 inches). In some embodiments, the launch guidance structure may include a series of individual subsections that screw or snap into each other and when fully screwed together, extend to a height greater than the average adult.

In some embodiments, a series of tilt switches may be attached to the launch surface of a toy rocket launch platform. The switches may be integrated into an electrical circuit connecting a power supply to an ignition system. The switches can be positioned in series and are located near or at the edge of the moveable launch surface. When every switch is closed, a toy rocket launch may occur. However, if at least one switch is open, the connection between the power supply and the ignition system is cut and a rocket launch is impossible. In some embodiments, the circuit can include a handheld switch to be operated by a user. If a user closes the handheld switch and every other switch is also closed, the ignition system will receive power and proceed to ignite a toy rocket. However, if a user closes the handheld switch and one or more switches embedded into the launch surface of the toy rocket launch platform are open, a launch will not occur. An embedded switch can automatically transition from a closed state to an open state if the launch surface of the toy rocket launch platform vertically tilts, axially rotates, vertically lifts, or horizontally shifts away from the proper orientation. The switches can automatically close if the launch surface is level to the static support structure and aligned with the central vertical axis of the static support structure.

In the following description, for the purposes of explanation, numerous specific details are set forth in order to provide a thorough understanding of embodiments of the present technology. It will be apparent, however, to one skilled in the art that embodiments of the present technology may be practiced without some of these specific details. While, for convenience, embodiments of the present technology are described with reference to toy rocket safety features to prevent injury during launch or injury during an inadvertent launch. Embodiments of the present technology are equally applicable to various other self-propelled flying toys.

Moreover, the phrase "rocket" or "toy rocket," as generally used herein refers to a self-propelled projectile (e.g., in that a rocket carries its own propulsion system). In contrast, a "projectile" is not self-propelled and requires an external power source such as springs, gas, or water and a mechanism located on or near a launch platform. The term "missile" also generally refers to a projectile and itself cannot be a rocket, however a rocket itself may also be a missile, especially after it runs out of propellant and continues to travel. As used herein, the term "rocket" apples to the technically correct use of the term, that being a self-propelled projectile, as well as a simple projectile.

The phrases "in some embodiments," "according to some embodiments," "in the embodiments shown," "in other embodiments," and the like generally mean the particular feature, structure, or characteristic following the phrase is included in at least one implementation of the present technology, and may be included in more than one implementation. In addition, such phrases do not necessarily refer to the same embodiments or different embodiments.

FIG. 1 illustrates an example of a rocket launch system 100 in accordance with some of the embodiments of the present technology. As illustrated in FIG. 1, rocket launch system includes launch platform 105. Launch platform 105 can include moveable platform 110 and static platform 115. In accordance with various embodiments, moveable platform 110 can be pivotably connected to the top of static platform 115. In some embodiments, moveable platform 110 may be vertically tilted, axially rotated, vertically lifted, or horizontally shifted while remaining pivotably connected to static platform 115.

While static platform 115 and moveable platform 110 are shown as squares in the embodiments shown in FIG. 1, neither static platform 115 nor moveable platform 110 are limited by geometric shape. As such, in some embodiments (not shown in FIG. 1) the moveable platform 110 and/or static platform 115 may be a circle, triangle, rhombus, rectangle, trapezoid, other geometric shape, custom shape, or the like. Static platform 115 maybe placed directly on the ground (e.g., street, grass, concrete, etc.) or on another stable surface. Static platform 115 can provide structural support for the moveable platform 110 and any other structure, system, or rocket placed or attached to the moveable platform 110. In accordance with various embodiments, moveable platform 110 and static platform 115 may be made from metal, wood, plastic, and/or any other material capable of supporting and withstanding the launch of a toy rocket. Additionally, moveable platform 110 and static platform 115 may be made from the same material or may be entirely different materials.

In the embodiments illustrated in FIG. 1, the base of static platform 115 can include support members 140 (e.g., posts, suction cups, spikes, casters, etc.). Support members 140 can provide a slip proof surface which prevents static platform 115 from moving horizontally along the ground or floor. In some embodiments, support members 140 may include wheels or casters allowing for easy movement of the static platform 115. In some embodiments, support members 140 can be constructed from rubber, silicone, or any other material with a sufficiently large static friction coefficient as to prevent lateral movement. In some embodiments, support members 140 may be a spike construction which inserts into the ground thereby preventing lateral movement. Support members 140 may be arranged along the periphery of the base of static platform 115 or in the corners as illustrated in FIG. 1. Alternatively, support members 140 may be placed within the interior or cover the entirety of the base of static platform 115. For example, in some embodiments, the bottom surface can include rough surface features such as grooves, indentations, or convex bumps which when in contact with the ground or floor, inhibit lateral movement of static platform 115.

In the embodiments illustrated in FIG. 1, located between static platform 115 and moveable platform 110 can be vertical switches 120. Vertical switches 120 can be positioned near or at the periphery of either static platform 115 or moveable platform 110. Alternatively, vertical switches 120 may be a two-piece construction where one section of the switch is connected to moveable platform 110 and the second section of the switch is located on static platform 115. Vertical switches 120 can be electrically connected to each other in series so that if one switch of vertical switches 120 disconnects (e.g., opens), the entire electrical circuit is disrupted. Vertical switches 120 may be ball switches, tilt switches, post switches, mercury switches, or any other switch which disconnects due to vertical or lateral movement or any combination thereof.

In some embodiments, vertical switches 120 can be integrated into an electrical circuit connecting a power supply such as a battery or wall outlet, to ignition system 135. When moveable platform 110 is vertically tilted, axially rotated, vertically lifted, and/or horizontally shifted while pivotably connected to static platform 115, one or more of vertical switches 120 disconnect (e.g., transition to an open state) which interrupts the electrical circuit. Once the electrical circuit is interrupted, a power supply can no longer provide electricity to ignition system 135 thereby inhibiting the function of ignition system 135 and preventing a rocket launch from occurring.

Ignition system 135 can be operatively coupled to toy rocket 145 and provides means to ignite or to initiate the launch of toy rocket 145 when prompted by a user. Ignition system 135 can be connected to a power supply via an electrical circuit which passes through vertical switches 120. Ignition system 135 may provide a propellant such as pressurized steam, or pressurized air to toy rocket 145. Alternatively, ignition system 135 may activate the release of a propellant already contained within toy rocket 145 as to initiate a launch. The release of the propellant contained within toy rocket 145 may constitute igniting solid or liquid fuel within the rocket, igniting an explosive charge within the rocket, or releasing pressurized steam or pressurized gas contained within the rocket. However, ignition system 135 may only be activated when each individual switch of vertical switches 120 is closed.

Attached to the center, or near the center of the upper surface of moveable platform 110 is launch guidance structure 125. Launch guidance structure 125 can be operatively coupled to toy rocket 145. In some embodiments, launch guidance structure 125 may be inserted into an appropriately shaped mold on the surface of moveable platform 110 or alternatively, may screw into the surface of moveable platform 110. Launch guidance structure 125 may include multiple pole segments 130. Pole segments 130 may screw into one another or may include pre-shaped molds which allow them to insert into one another. In some embodiments, pole segments 130 may telescope out from one another to form launch guidance structure 125. Pole segments 130 may be made from metal, wood, and/or plastic, or any other material capable of withstanding the launch of a toy rocket. Launch guidance structure 125 is not limited by the number of individual pole segments or by geometric configuration of pole segments. Launch guidance structure 125 is a passive guidance system that dictates the initial trajectory of toy rocket. That is, when toy rocket 145 is ignited, the toy rocket 145 will follow a path parallel to the vertical axis of launch guidance structure 125 until reaching an elevation equal to the height of launch guidance structure 125 where toy rocket 145 then detaches and continues on the flight path.

In some embodiments, toy rocket 145 can be coupled to the exterior of launch guidance structure 125. In other embodiments, toy rocket 145 may be inserted into the interior of launch guidance structure 125 and when toy rocket 145 is ignited, passes through launch guidance structure 125 before exiting. Launch guidance structure 125 may extend to at least six feet in height or may extend to a height greater than that of the average adult person. In some embodiments, launch guidance structure 125 does not release control over the trajectory of toy rocket 145 until toy rocket 145 has reached an elevation greater than the height of an average adult person.

Figure 2A:
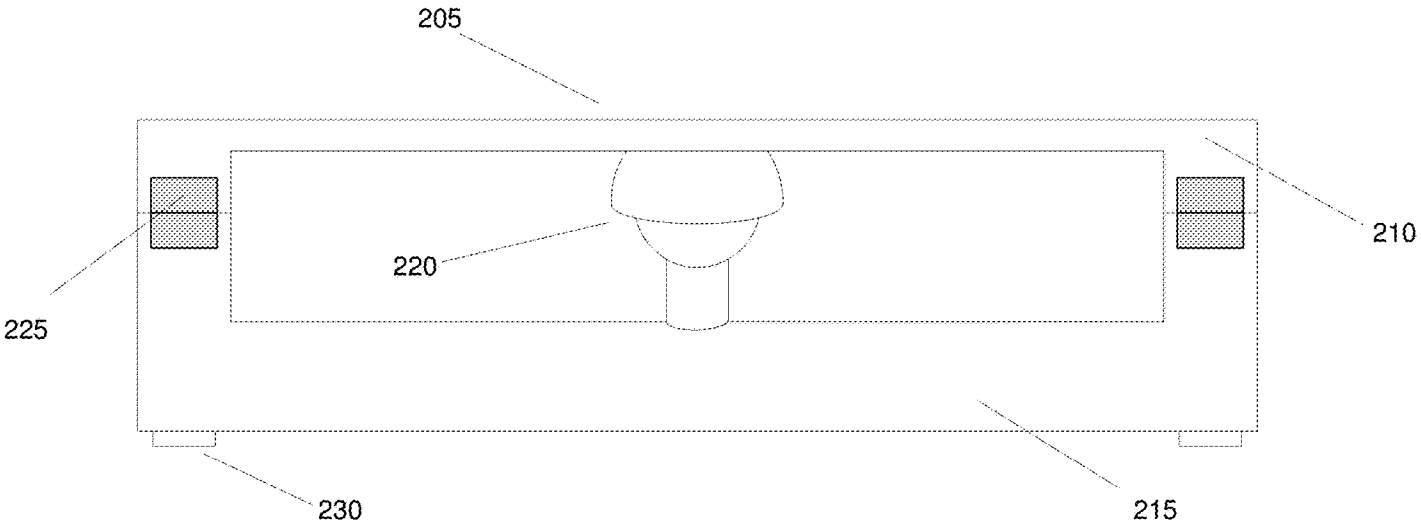
FIG. 2A illustrates an example of a pivot mechanism for a toy rocket launch platform according to one or more embodiments of the present technology.

Now referring to FIG. 2A, where rocket platform 205 is presented in accordance with some embodiments of the present technology. In the embodiments illustrated in FIG. 2A, rocket platform 205 includes launch surface 210 operatively coupled to static base 215 by pivot mechanism 220. Spanning across launch surface 210 and static base 215 are tilt switches 225. Tilt switches 225 can be embedded in an electrical circuit contained within static base 215 and launch surface 210. When launch platform 210 is level to the surface of and in contact with static base 215, tilt switches 225 are closed thereby allowing the electrical circuit contained within launch surface 210 and static base 215 to operate uninterrupted.

However, if the orientation of launch surface 210 is changed where the launch surface 210 is no longer level to static base 215, is disconnected from static base 215, or is rotated to be not in-line with static base 215, one or more tilt switches of tilt switches 225 open causing the electrical circuit to cease functioning. On the bottom surface of static base 215 are support structures 230. Launch surface 210 provides a surface from which a toy rocket may launch from. Launch surface 210 may be metal, wood, or plastic, or any material capable of withstanding the changes in temperature or pressure that may occur during the launch of a toy rocket. Launch surface 210 is not limited by geometric shape. Static base 215 provides support to launch surface 210 and any structure or rocket that may be attached or placed onto launch surface 210. Support structures 230 can be arranged on the bottom surface of static base 215 and may be rubber or silicone legs as to prevent lateral movement of static base 215.

In the embodiment illustrated in FIG. 2A, connecting launch surface 210 and static base 215 is pivot mechanism 220 which can be any mechanism that allows launch surface 210 to vertically tilt, axially rotate, vertically lift, or horizontally shift. In accordance with various embodiments, pivot mechanism 220 may be a ball-and-socket mechanism, a pivot post, a spring, a lever system, or another mechanism which provides structural support to launch surface 210 while allowing launch surface 210 freedom of movement. In some embodiments, pivot mechanism 220 can be attached to the center of the upper surface of static base 215. Pivot mechanism 220 may be located entirely on static base 215 or may be split between static base 215 and launch surface 210 such that one piece of the pivot mechanism 220 can be adhered to static base 215 while the second piece of the pivot mechanism 220 is adhered to launch surface 210.

In some embodiments, pivot mechanism 220 may be a lock-and-key type mechanism such that pivot mechanism 220 may only connect static base 215 and launch surface 210 in a specific way. In other embodiments, pivot mechanism 220 may connect launch surface 210 and static base 215 magnetically, through molded surface features, by screws, by welds, or through adhesive or linking mechanism. Alternatively, pivot mechanism 220 may be built into the body of static base 215 or launch surface 210.

Figure 2B:
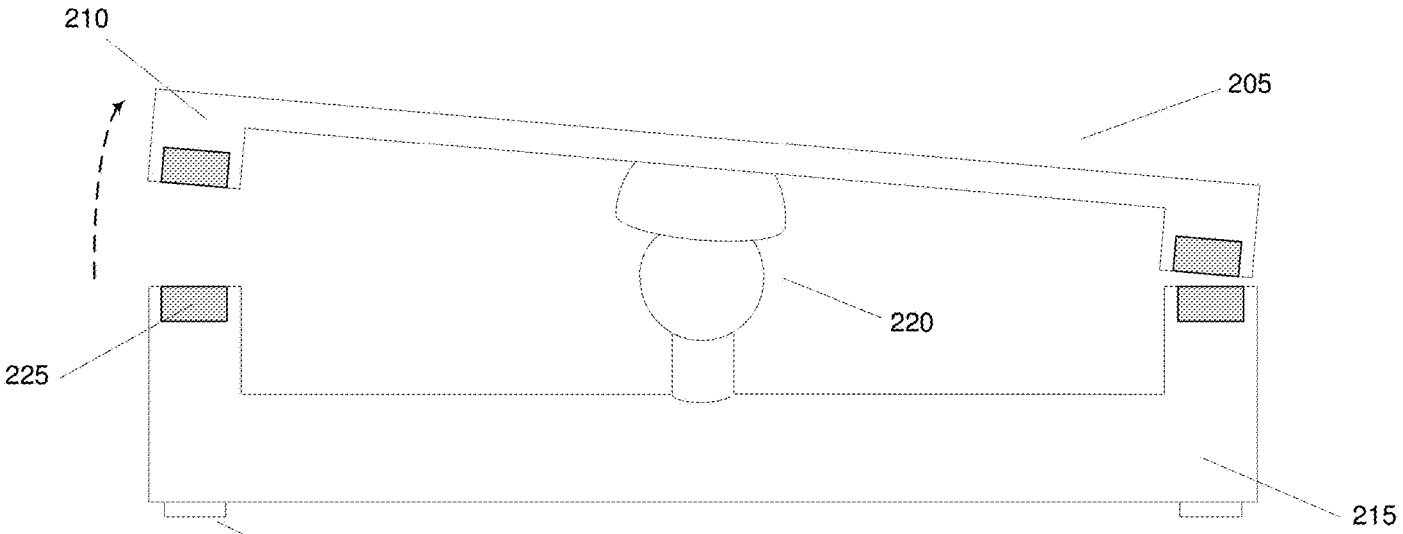
FIG. 2B illustrates an example of an operation of a pivot mechanism for a toy rocket launch platform according to one or more embodiments of the present technology.

FIG. 2B illustrates an example of the operation of a toy rocket launch safety system according to one or more embodiments of the present technology. As illustrated in FIG. 2B, rocket launch platform 205 includes launch surface 210 which has been vertically tilted (e.g., as allowed by means of pivot mechanism 220) so that launch surface 210 is no longer level to the surface of base platform 215. The vertical tilting of launch surface 210 forces tilt switches 225 to become disconnected and the electrical circuit that tilt switches 225 are embedded into to open state. When one or more tilt switches of tilt switches 225 are disconnected, a rocket launch can no longer occur. As a result, a toy rocket will not launch when rocket launch platform 205 is tilted (e.g., greater than two degrees, five degrees, ten degrees, fifteen degrees, or the like depending on the design). Hence, the toy rocket will only launch straight up (or substantially straight up) into the air when the launch surface is level and the tilt switch remain closed.

Figure 3A:
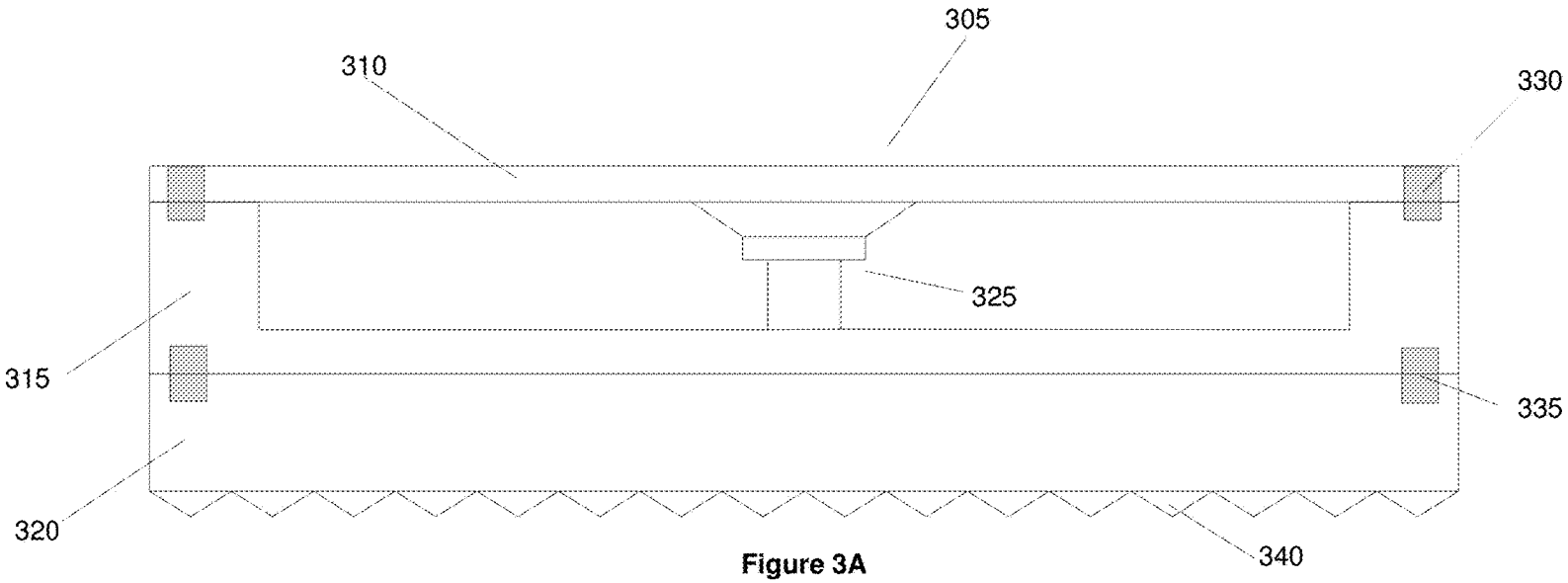
FIG. 3A illustrates an example of a pivot mechanism for a toy rocket launch platform according to one or more embodiments of the present technology.

FIG. 3A illustrates an example of a toy rocket launch platform safety system according to one or more embodiments of the present technology. In the embodiments illustrated in FIG. 3A, toy rocket launch platform 305 includes moveable launch platform 310, moveable base 315, static base 320, pivot system 325, primary switches 330, secondary switches 335, and surface features 340. Moveable launch platform 310 can be connected to moveable base 315 by pivot system 325. Pivot system 325 allows moveable launch platform 310 to vertically tilt, axially rotate, or vertically lift. When moveable launch platform 310 is connected and positioned level to the horizonal axis of moveable base 315 as well as in line with the central vertical axis of moveable base 315, primary switches 330 remain closed. If moveable launch platform 310 exits this configuration, then one or more switches of primary switches 330 may open preventing launch of a toy rocket (e.g., 145 in FIG. 1).

In the embodiments illustrated in FIG. 3A, moveable base 315 can be positioned atop static base 320 and may move on a lateral or horizontal axis to the ground. When moveable base 315 is positioned along the central vertical axis of static base 320, secondary switches 335 are closed. However, when moveable base 315 shifts to no longer be positioned on the central vertical axis of static base 320, then one or more switches of secondary switches 335 may be opened. In some embodiments, moveable base 315 and static base 320 may be a construction of concentric disks (e.g., one moveable and one static) where moveable base 315 is a moveable disk that is centered on static base 320 where static base 320 is a static disk. Moveable base 315 can move laterally while remaining in contact with static base 320.

If moveable base 315 is positioned anywhere outside of the central axis of static base 320, secondary switches 335 are opened. In other embodiments, moveable base 315 and static base 320 may be a set of surfaces operatively coupled such that they slide over one another. In still further embodiments, moveable base 315 may be incorporated into pivot system 325 such that pivot system 325 can also move laterally. On the bottom side of static base 320 are surface features 340. Surface features 340 may be bumps, grooves, treads, or indentations or any other feature as to increase the static friction coefficient of the bottom surface of static base 320. Surface features 340 can be rubber or silicone, or can be the same material that makes up static base 320.

Primary switches 330 and secondary switches 335 may be embedded in a circuitry system connecting a power supply and ignition system 135. Primary switches 330 and secondary switches 335 integrate into the circuitry system in series. If any one or more switches of primary switches 330 or secondary switches 335 become open, the entire circuitry system is disabled. Primary switches may be opened by vertical or rotational movement of moveable launch platform 310. Secondary switches 335 may be opened by lateral movement of moveable base 315. If any one of primary switches 330 or secondary switches 335 are opened, a toy rocket launch from moveable launch platform 310 cannot occur.

Figure 3B:
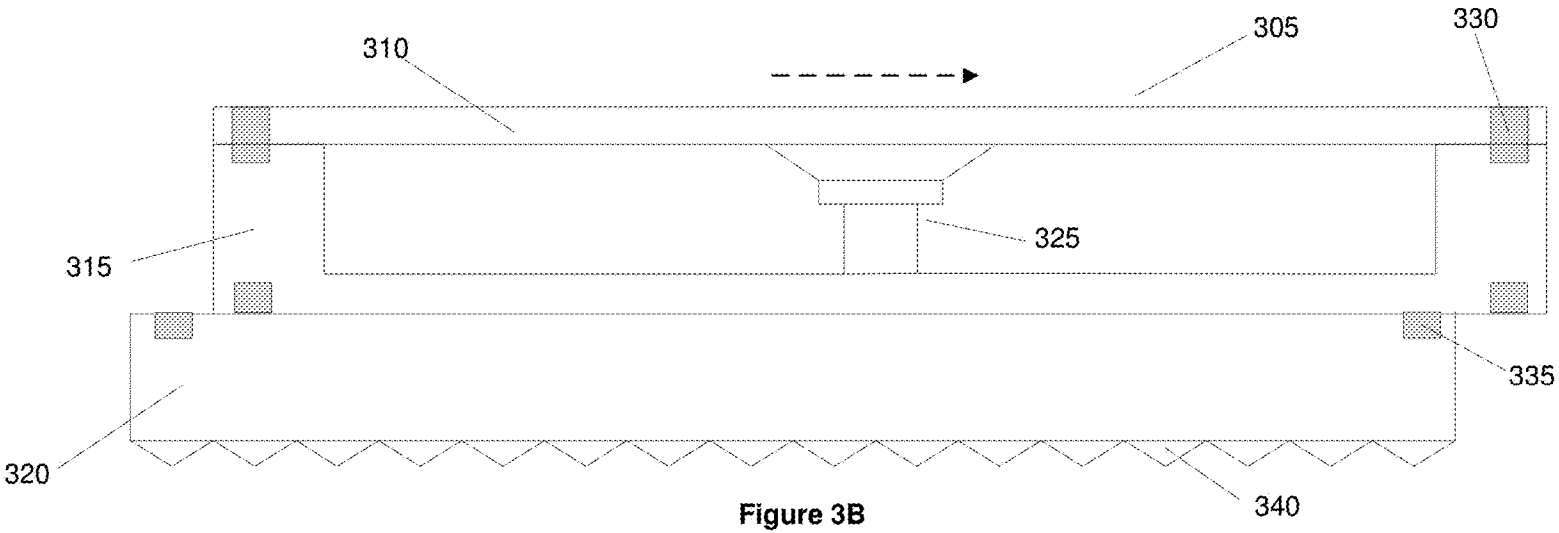
FIG. 3B illustrates an example of an operation of a pivot mechanism for a toy rocket launch platform according to one or more embodiments of the present technology.

FIG. 3B demonstrates an example of the operation of a toy rocket launch safety system according to one or more embodiments of the present technology. As illustrated in FIG. 3B, toy rocket launch platform 305 can allow moveable base 315 to shift laterally thereby positioning moveable base 315 off of the central axis of static base 320. The lateral shifting of movable base 315 forces one or more switches of secondary switches 335 to become disconnected and the electrical circuit that secondary switches 335 are embedded into to open ensuring the toy rocket cannot launch. When one or more switches of secondary switches 335 are disconnected, a rocket launch from moveable launch platform 310 can no longer occur.

Figure 4B:
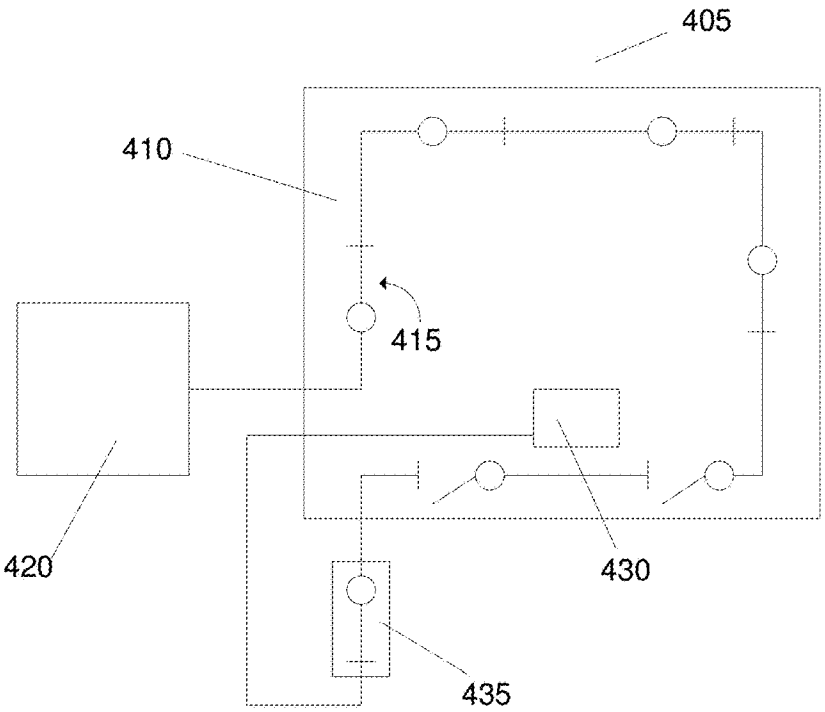
FIG. 4B illustrates an example of an operation of a system of tilt switches for a toy rocket launch platform safety system in accordance with some embodiments of the present technology.
Figure 4A:
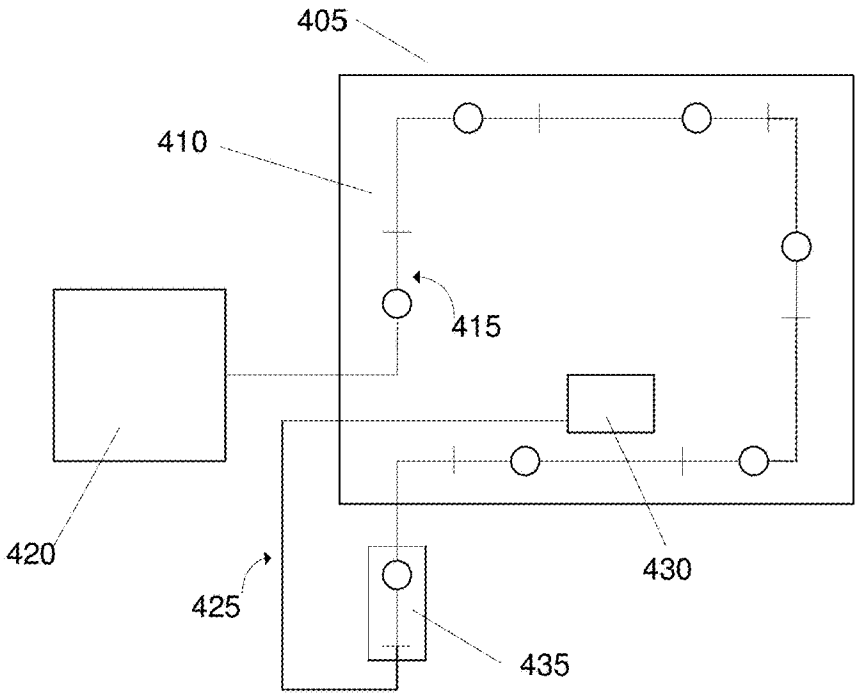
FIG. 4A illustrates an example of a system of tilt switches for a toy rocket launch platform safety system according to one or more embodiments of the present technology.

FIG. 4A illustrates an example of a circuitry system in accordance with various embodiments of the present technology. In the embodiments illustrated in FIG. 4A, toy rocket safety system 405 includes launch pad 410, switches 415, power supply 420, circuitry 425, ignition system 430, and handheld switch 435. Launch pad 410 can includes a moveable platform that may vertically tilt, laterally shift, vertically lift, axially rotate, or otherwise move indicating that the launch pad 410 is not level, stable, or otherwise in a safe position to allow launch of a toy rocket (e.g., 145 in FIG. 1). In accordance with various embodiments, switches 415 may be embedded onto the bottom side of launch pad 410 and are connected in series by circuitry 425. Switches 415 may be tilt switches, post switches, ball switches, or mercury switches. In some embodiments, switches 415 remain closed when launch pad 410 is in the correct conformation but open when launch pad 410 vertically tilts, laterally shifts, vertically lifts, or axially rotates away from the correct conformation. Switches 415 can be positioned near the periphery of launch pad 410 and are not limited by number of switches or type of switches. Circuitry 425 provides means for power supply 420 to supply electricity to ignition system 430. Circuitry 425 may be any type of insulated wiring capable of transmitting electricity such as copper wiring, gold wiring, or silver wiring.

In accordance with various embodiments, handheld switch 435 allows a user to open and close circuitry 425 thereby supplying or cutting power to ignition system 430. For example, the handheld switch may be configured as a "dead man's" switch which has a default position as open preventing launch and requires pressing of a button (or other switch) to close the circuit enabling launch. When each switch of switches 415 are closed, a user may close handheld switch 435 to supply power to ignition system 430 which may precipitate a rocket launch from launch pad 410.

Handheld switch 435 may be a wall switch, a miniature toggle switch, an in-line switch, a push-button switch, a rocker switch, or a microswitch. In alternative embodiments, handheld switch may be wirelessly integrated into circuitry 425 through Bluetooth, WiFi, or radio frequency. Handheld switch 435 may be built into the physical structure of launch pad 410 or may instead be detached from launch pad 410 and connect to launch pad 410 via a wired or wireless connection.

Power supply 420 may be any device capable of supplying electrical current and may exist as a wall outlet, a battery, a fuel powered generator, a solar power generator, a hydrogen fuel cell, or some other type of electrical power source. Ignition system 430 can be operatively coupled to toy rocket, toy missile, or some other type of self-propelled projectile. In some embodiments, ignition system 430 may ignite a fuel source contained within a toy rocket placed on launch pad 410 or may instead supply a fuel source such as compressed gas to a toy rocket positioned on the surface of launch pad 410. Ignition system 430 can activate when each switch of switches 415 is closed and handheld switch 435 is also closed.

FIG. 4B presents an alternative modality of toy rocket safety system 405 according to at least one or more embodiments of the present technology. In the embodiments illustrated in FIG. 4B, toy rocket safety system 405 includes launch pad 410, switches 415, power supply 420, circuitry 425, ignition system 430, and handheld switch 435. In these embodiments, launch pad 410 has been moved such that launch pad 410 is no longer in the correct conformation as to allow a rocket launch. The movement of launch pad 410 causes one or more switches of switches 415 to open which results in the cessation of the electrical connection between power supply 420 and ignition system 430. Even if a user is to close handheld switch 435, a rocket launch would not occur so long as launch pad 410 remains in the incorrect conformation.

Figure 5B:
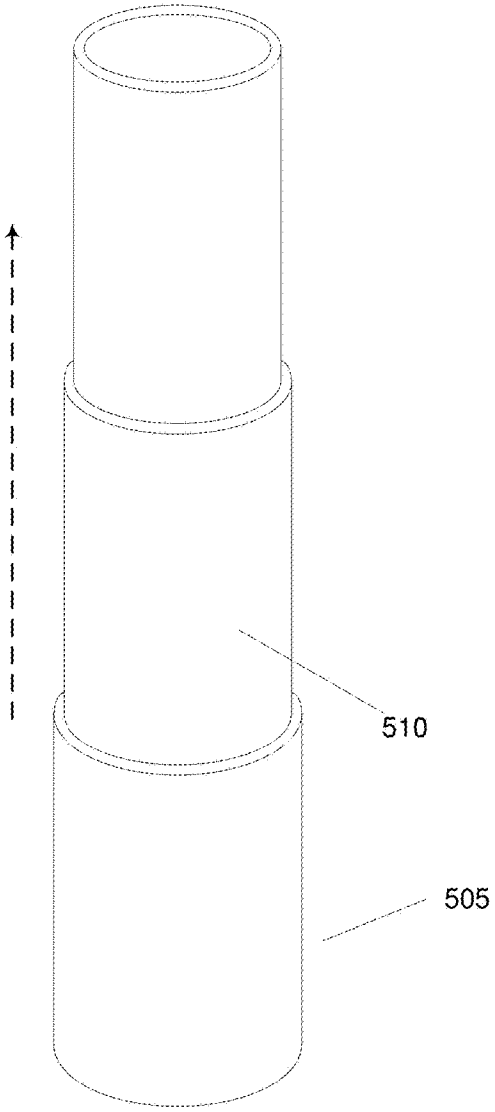
FIG. 5B illustrates an example of an operation of a launch guidance system for a toy rocket launch platform according to one or more embodiments of the present technology.
Figure 5A:
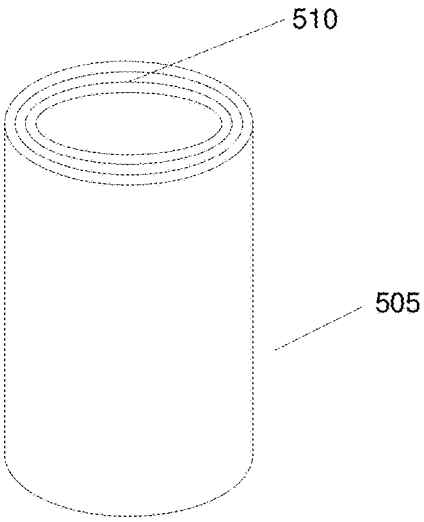
FIG. 5A illustrates an example of a launch guidance system for a toy rocket launch platform according to one of more embodiments of the present technology.

FIG. 5A illustrates an example of a launch guidance structure 505 in accordance with some embodiments of the present technology. In the embodiments illustrated in FIG. 5A, launch guidance system (or structure) 505 includes concentric subsections 510 which can be interconnected in a telescoping manner. As illustrated in FIG. 5A, launch guidance structure 505 may be cylindrical and can be attached to the upper surface of a toy rocket launch platform and includes concentric subsections 510. Concentric subsections 510 interlock together with each subsection having a smaller radius than the encompassing subsection. Launch guidance structure 505 may be constructed from metal, plastic, or wood or any other material or combination of materials capable of withstanding the launch of a toy rocket. The innermost concentric subsection of concentric subsections 510 has a radius large enough to fully encircle a toy rocket. When launch guidance structure 505 is attached to the surface of a toy rocket launch platform, a toy rocket may be inserted into the interior of launch guidance structure 505.

FIG. 5B presents an example of an alternative embodiment of a launch guidance structure according to the present technology. As illustrated in FIG. 5B, launch guidance structure 505 which includes concentric subsections 510 is shown. In some embodiments, once launch guidance structure 505 has been attached to the surface of a toy rocket launch platform and a toy rocket has been inserted into the interior launch guidance structure 505, concentric subsections 510 of launch guidance structure 505 may be vertically extended to a height of at least six feet. Once launch guidance structure 505 has been extended, a toy rocket inserted into the interior of launch guidance structure 505 may have a propellant ignited resulting in launch of the toy rocket.

Figure 6:
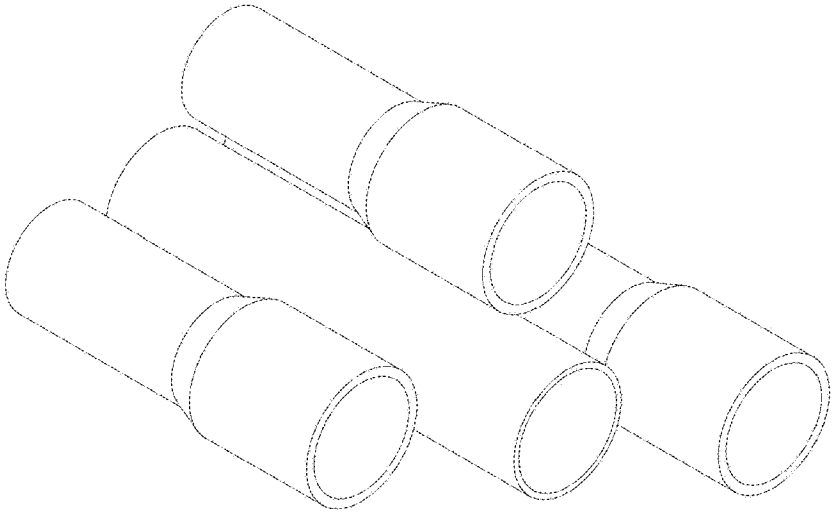
FIG. 6 illustrates examples of mating systems for a launch guidance system in accordance with some embodiments of the present technology.
Figure 6:
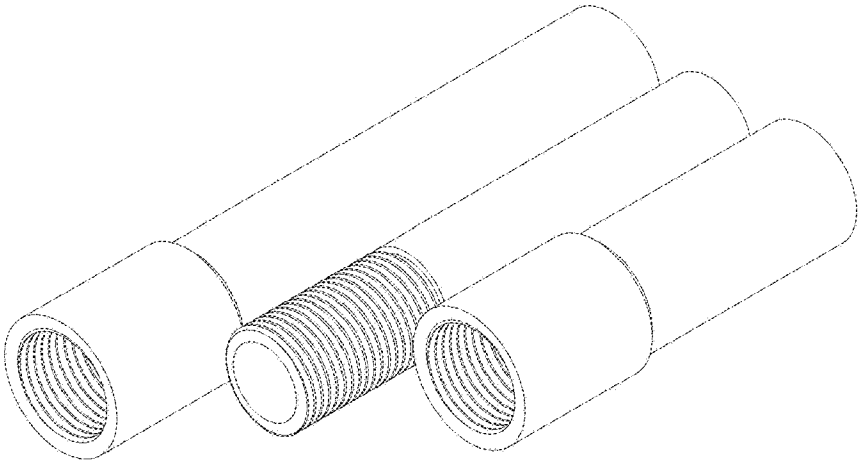

FIG. 6 illustrates examples of mating systems for a launch guidance structure according to one or more embodiments of the present technology. FIG. 6 includes presents illustrations of different modes of assembly for a launch guidance structure. In some embodiments, a launch guidance structure can be assembled from individual subsections which may screw together. Each subsection may contain a male end and a female end that thread together. In some embodiments, the individual subsections of a launch guidance structure may contain molds which allow each subsection to be inserted into one another to form a launch guidance structure.

Figure 7:
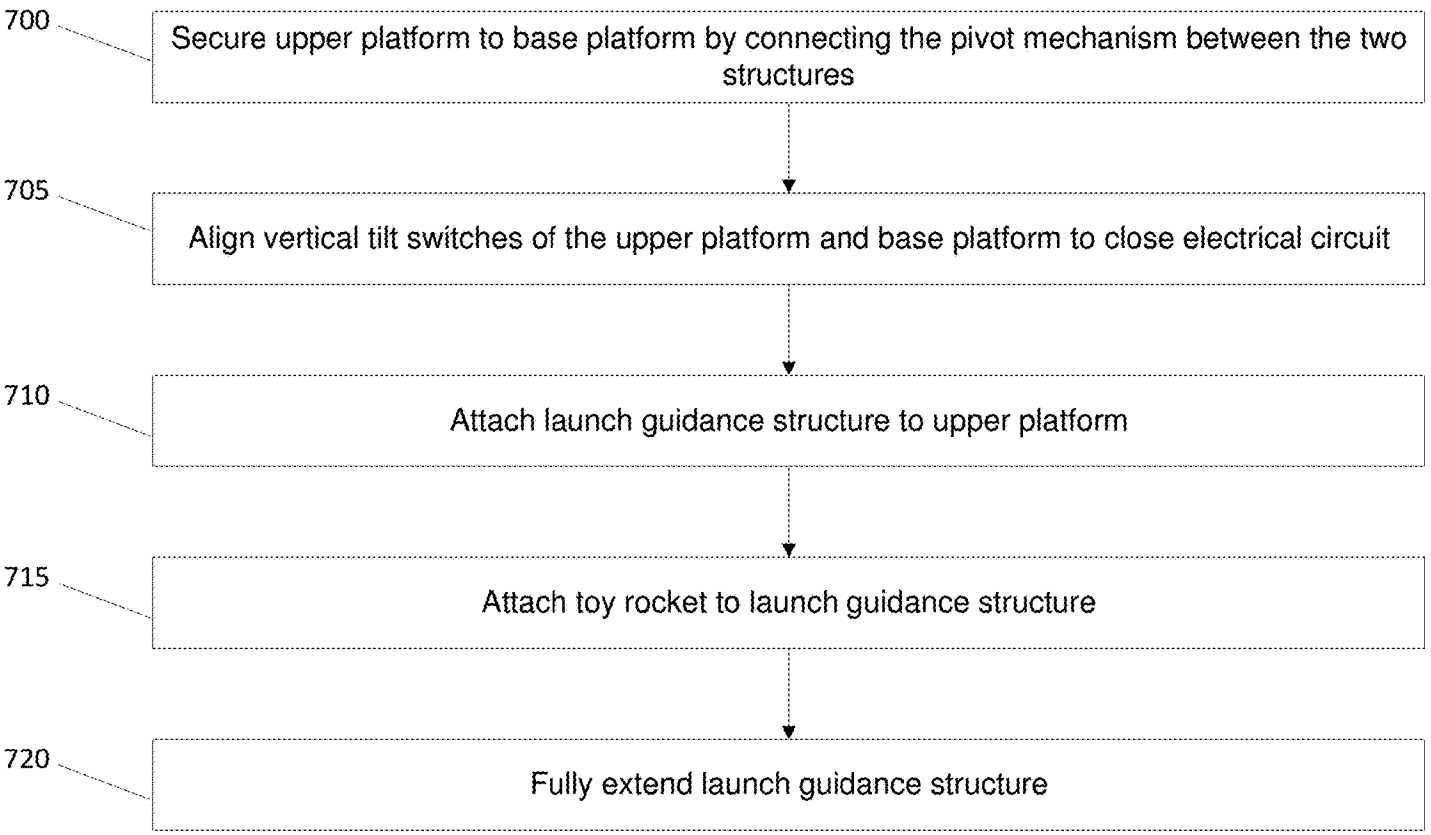
FIG. 7 is a flowchart illustrating an example of a set of operations of a toy rocket launch platform safety system according to various embodiments of the present technology.

FIG. 7 is a flowchart illustrating an example of a set of operations for a toy rocket launch safety system according to at least one embodiment of the present technology. In step 700, an upper platform is connected to a base platform by a pivot mechanism. The pivot mechanism connecting the upper platform and the base platform may be a lock-and-key type mechanism such that the upper platform and the base platform may only be connected in a specific way. In some embodiments, the pivot mechanism may magnetically connect the upper and base platform or may connect the upper and base platform via an adhesive such as glue or tape. Once the connection between the upper platform and the base platform has been established, the upper platform can move independently from the base platform. The pivot mechanism allows the upper platform to move vertically, laterally, or rotationally while the base platform remains stationary.

Moving on to step 705, the vertical tilt switches of the upper platform and the base platform are aligned to close an electrical circuit embedded in the platforms. To align the vertical tilt switches, the upper platform is positioned on a plane level to the horizontal surface of the base platform and along the central vertical axis of the base platform such that the upper platform and the base platform share the same central vertical axis. Once the upper platform is aligned in this manner, it is rotated until the vertical tilt switches of the upper platform and the base platform are connected.

After the vertical tilt switches have been connected, in step 710, a launch guidance structure is attached to the upper platform. The launch guidance structure may be mounted to the upper platform by a screw type mechanism, an appropriately sized mold, by magnets, by tape, or by an adhesive. The launch guidance structure can be a cylindrical tube and is positioned at or near the center of the upper platform and extends vertically from the upper platform. Once the launch guidance structure has been attached, in step 715 a toy rocket is attached to the launch guidance structure. In some embodiments, the toy rocket is coupled to the exterior of the launch guidance structure so that when the toy rocket ignites, it follows a flight path dictated by the launch guidance structure. In other embodiments, the toy rocket is not attached to the launch guidance structure but is inserted into the interior of the launch guidance structure.

Moving on to step 720, the launch guidance structure is then fully extended (e.g., to at least six feet in height). Some embodiments may include a series of switches within the guidance structure which will only allow activation of the firing system, and launch of the rocket, when the launch guidance structure is fully extended or assembled.

The launch guidance structure may exist as series of concentric tubes that can be extended by telescoping the tubes out from one another. In alternative embodiments, the launch guidance structure may exist as a series of subsections and is extended by attaching together. Each subsection may attach by screwing together, molding together, or snapping together. Alternatively, the launch guidance structure may simply include a single, non-collapsible pole greater that six feet in height.

Conclusion

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the technology is not intended to be exhaustive or to limit the technology to the precise form disclosed above. While specific examples for the technology are described above for illustrative purposes, various equivalent modifications are possible within the scope of the technology, as those skilled in the relevant art will recognize. For example, while processes or blocks are presented in a given order, alternative implementations may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

The teachings of the technology provided herein can be applied to other systems, not necessarily the system described above. The elements and acts of the various examples described above can be combined to provide further implementations of the technology. Some alternative implementations of the technology may include not only additional elements to those implementations noted above, but also may include fewer elements.

These and other changes can be made to the technology in light of the above Detailed Description. While the above description describes certain examples of the technology, and describes the best mode contemplated, no matter how detailed the above appears in text, the technology can be practiced in many ways. Details of the system may vary considerably in its specific implementation, while still being encompassed by the technology disclosed herein. As noted above, particular terminology used when describing certain features or aspects of the technology should not be taken to imply that the terminology is being redefined herein to be restricted to any specific characteristics, features, or aspects of the technology with which that terminology is associated. In general, the terms used in the following claims should not be construed to limit the technology to the specific examples disclosed in the specification, unless the above Detailed Description section explicitly defines such terms. Accordingly, the actual scope of the technology encompasses not only the disclosed examples, but also all equivalent ways of practicing or implementing the technology under the claims.

To reduce the number of claims, certain aspects of the technology are presented below in certain claim forms, but the applicant contemplates the various aspects of the technology in any number of claim forms. For example, while only one aspect of the technology is recited as a computer-readable medium claim, other aspects may likewise be embodied as a computer-readable medium claim, or in other forms, such as being embodied in a means-plus-function claim. Any claims intended to be treated under 35 U.S.C. § 112(f) will begin with the words "means for", but use of the term "for" in any other context is not intended to invoke treatment under 35 U.S.C. § 112(f). Accordingly, the applicant reserves the right to pursue additional claims after filing this application to pursue such additional claim forms, in either this application or in a continuing application.

What is claimed is:

1. A system to facilitate safety and functionality for launching a toy rocket, the system comprising:

a moveable launch platform that provides a surface on which the toy rocket launches;

a fixed base making stationary contact with a surface;

a pivot connecting the fixed base to the moveable launch platform, wherein the pivot allows the moveable launch platform to move independently of the fixed base;

an ignition system that, once activated by an ignition switch, causes the toy rocket to launch;

a circuitry system connecting a power supply to the ignition switch;

a plurality of electrical switches positioned in series on the moveable launch platform wherein the plurality of electrical switches, when closed, complete an electrical circuit of the circuitry system; and a launch guidance structure attached to an upper surface of the moveable launch platform.

2. The system of claim 1, wherein the plurality of electrical switches are opened when the moveable launch platform is not level; and the plurality of electrical switches are opened when the moveable launch platform is not aligned with a central vertical axis of the fixed base.

3. The system of claim 2, wherein the plurality of electrical switches, when open, breaks an electrical connection of the circuitry system between the ignition system and the ignition switch.

4. The system of claim 1, wherein the plurality of electrical switches comprises tilt switches, ball switches, mercury switches, or post switches.

5. The system of claim 1, wherein the pivot connecting the moveable launch platform to the fixed base is a ball and socket mechanism, a pivot post, a spring, or other pivoting post.

6. The system of claim 1, wherein the launch guidance structure is a collapsible pole with a length greater than six feet when fully extended.

7. The system of claim 6, wherein the collapsible pole further comprises a series of poles arranged concentrically that telescope out from one another.

8. The system of claim 6, wherein the collapsible pole attaches to the launch surface by inserting into the launch surface or by screwing onto the launch surface.

9. An apparatus to prevent an inadvertent launch of a toy rocket, the apparatus comprising:

a system of vertical tilt switches positioned near an outer perimeter of a moveable launch pad;

an electrical system embedded into the moveable launch pad wherein the system of vertical tilt switches attaches in series to the electrical system;

a power supply wherein the power supply is connected to the electrical system;

an ignition system coupled to the electrical system wherein the ignition system, when powered by the power supply, initiates a launch of a toy rocket;

a handheld switch integrated into the electrical system wherein the handheld switch is integrated into the electrical system between the system of vertical tilt switches and the power supply.

10. The apparatus of claim 9, wherein the system of vertical tilt switches are closed when the moveable launch pad is level to a horizontal axis of a static base structure.

11. The apparatus of claim 9, wherein the ignition system is powered when each switch of the system of vertical tilt switches and the handheld switch are closed.

12. The apparatus of claim 9, wherein the handheld switch is any one of a wall switch, a miniature toggle switch, an in-line switch, a push-button switch, a rocker switch, or a microswitch.

13. The apparatus of claim 12, wherein the handheld switch, when open, prevents the ignition system from receiving power from the power supply.

14. A method for assembling a toy rocket launch safety system, the method comprising:

securing an upper platform to a base platform, wherein securing the upper platform includes connecting the upper platform to the base platform by a pivot mechanism;

aligning the upper platform to the base platform, wherein aligning the upper platform includes connecting a system of switches to close an electrical circuit;

attaching a launch guidance structure to an upper surface of the upper platform;

attaching a toy rocket to the launch guidance structure; and extending the launch guidance structure.

15. The method of claim 14, wherein securing the upper platform to the base platform further comprises connecting the base platform to the upper platform with a lock-and-key type pivot mechanism.

16. The method of claim 14, wherein the upper platform can axially rotate, vertically tilt, vertically lift, and horizontally shift.

17. The method of claim 16, wherein the system of switches open when the upper platform axially rotates, vertically tilts, vertically, lifts, or horizontally shifts.

18. The method of claim 14, wherein attaching the launch guidance structure to the upper surface of the upper platform further comprises screwing the launch guidance structure into the upper surface.

19. The method of claim 14, wherein attaching the launch guidance structure to the upper surface of the upper platform further comprises inserting the launch guidance structure into a mold on the upper surface.

20. The method of claim 14, wherein attaching the toy rocket to the launch guidance structure further comprises inserting the toy rocket into an interior space of the launch guidance structure.

* * * * *